US007151512B2

(12) United States Patent
Johnson et al.

(10) Patent No.: US 7,151,512 B2
(45) Date of Patent: Dec. 19, 2006

(54) DISPLAY DEVICE

(75) Inventors: Mark Thomas Johnson, Eindhoven (NL); Adrianus Sempel, Eindhoven (NL); Remco Los, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 576 days.

(21) Appl. No.: 10/131,774

(22) Filed: Apr. 24, 2002

(65) Prior Publication Data

US 2002/0167473 A1 Nov. 14, 2002

(30) Foreign Application Priority Data

Apr. 26, 2001 (EP) ..... 01201526

(51) Int. Cl.
*G09G 3/30* (2006.01)

(52) U.S. Cl. ..... 345/76; 345/100; 345/691; 315/169.3

(58) Field of Classification Search ..... 345/82, 345/83, 84, 85, 76, 80, 89, 98, 100, 691, 345/692, 45, 46, 211; 313/500, 505; 315/169.3; 359/254

See application file for complete search history.

(56) References Cited

U.S. PATENT DOCUMENTS 5,130,703 A * 7/1992 Fairbanks et al. ..... 345/94
5,153,568 A * 10/1992 Shaw ..... 345/88
5,300,944 A * 4/1994 Shapiro et al. ..... 345/88
5,724,058 A * 3/1998 Choi et al. ..... 345/89
5,818,419 A * 10/1998 Tajima et al. ..... 345/691
6,014,119 A * 1/2000 Staring et al. ..... 345/82
6,035,065 A * 3/2000 Kobayashi et al. ..... 382/201
6,097,352 A * 8/2000 Zavracky et al. ..... 345/7
6,395,576 B1 * 5/2002 Chang et al. ..... 438/70
6,449,023 B1 * 9/2002 Swanson et al. ..... 349/62
6,498,592 B1 * 12/2002 Matthies ..... 345/1.1
2002/0035862 A1 3/2002 Moilanen et al. ..... 72/453.16

FOREIGN PATENT DOCUMENTS

WO WO9716811 10/1996

* cited by examiner

*Primary Examiner*—Richard Hjerpe
*Assistant Examiner*—Abbas Abdulselam

(57) ABSTRACT

To suppress dissipation in monochrome LED displays, each frame is supplied at half the frame rate. In color LED displays, one color frame (e.g. green) is supplied at the normal frame rate and the other colors (red, blue) are supplied at slower frame rates. In a further embodiment, frame rates of all colors are based on the image to be displayed.

20 Claims, 3 Drawing Sheets

Figure 1:
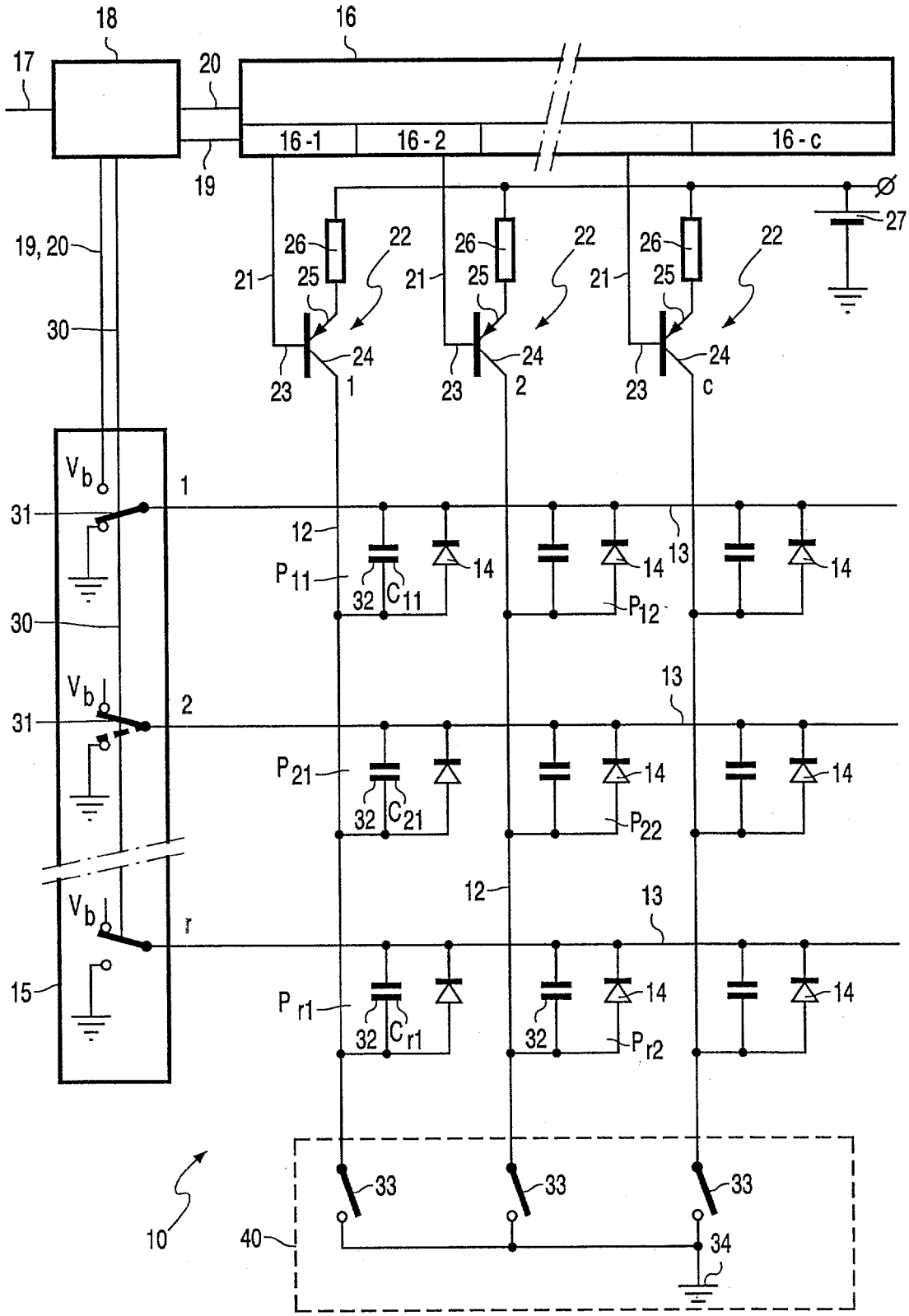

$t_{frame}$
$t_{sel}$
$t_{sel}$
$t_{sel}$
$t_{sel}$
$t_{sel}$
$t_{sel}$
$V_{sel}$ $V_{sel}$ $I_{data}$ $I_{data_1}$ $I_{data_2}$ $I_{data_1}$ $I_{data_2}$ $V_{sel_0}$ $V_{sel_0}$ $I_{1,2}$ $V_{sel}$
$V_{sel}$
$I_{data}$
$I_{data}$
$I_{data}$
$t_{sel}$
$t_{sel}$
$t_{sel}$
$t_{frame}$
$t_F$
G
RG
GB

DISPLAY DEVICE

The invention relates to a display device comprising a layer of electroluminescent material between a first pattern of selection electrodes and a second pattern of data electrodes, in which at least one of the two patterns is transparent to the radiation to be emitted, while at overlap areas of the electrodes, said electrodes, jointly with the interpositioned electroluminescent material, form part of pixels, the device comprising a drive circuit.

Such display devices (matrices of organic LEDs, polymer LEDs) find an increasingly wider application in, for example, mobile telephones.

A problem in driving such matrices of organic LEDs is the LED-associated capacitance constituted by the overlapping electrodes and the interpositioned layer or layers of organic material, as well as the capacitance of the drive lines. This is a problem because the LEDs are usually driven by means of current control so that, during use, a selected pixel is supplied with a substantially constant current. A large part of the initial current, which should actually flow through the relevant LED, charges the LED-associated capacitance so that the LED conveys too little current and consequently emits light at a too low luminance level. In larger matrices, the capacitance and the resistance of the drive lines also have their influence and, due to long RC times, the desired setting level during a writing period cannot be achieved in some cases. Moreover, switching requires much power.

It is an object of the present invention to provide a solution to the above-mentioned problem.

To this end, a display device according to the invention selects only a portion of the pixels per frame period.

Consequently, a plurality of LEDs in, for example, a row are less frequently driven so that they consume less energy during switching.

In a first embodiment, the pixels of the odd columns are supplied with a substantially constant current in every odd frame period in a matrix of pixels at overlap areas of the electrodes, and the pixels of the even columns are supplied with a substantially constant current in every even frame period, the currents being substantially doubled as compared with the current used in a drive circuit which, during use, selects all pixels per frame period. The invention is explicitly not limited to display devices with a matrix of pixels but is also applicable to a segmented display device.

Similarly, the pixels of the odd rows are supplied with a substantially constant current in every odd frame period in a matrix of pixels at overlap areas of the electrodes, and the pixels of the even rows are supplied with a substantially constant current in every even frame period, the currents being substantially doubled as compared with the current used in a drive circuit which, during use, selects all pixels per frame period.

The two measures may also be combined so that each pixel is selected only once per four frame periods. The current through a selected pixel is then quadrupled with respect to the drive in which all pixels are selected per frame period. To prevent too high currents, it is also possible to extend the drive pulse, provided that the product of time and current is substantially the same for each pixel as in a drive circuit which, during use, selects all pixels per frame period.

More generally, one or more pixels can be selected once per p frame periods, with a p-fold current being passed through the selected pixel.

In a preferred embodiment with n ($n \geqq 2$) sub-pixels of n colors, the sub-pixels of the different colors are supplied with a substantially constant current in n consecutive frame periods, the currents being n-fold as compared with the currents used in a drive circuit which, during use, selects all sub-pixels per frame period.

When using sub-pixels of n colors in some frame periods, the sub-pixels of one of the different colors can be selected and the sub-pixels of m ($m>1$, $m<n$) colors can be selected in other frame periods.

These and other aspects of the invention are apparent from and will be elucidated with reference to the embodiments described hereinafter.

Figures 2A, 2B, 2C, 2D, 2E, 2F, 2G, 2H, 2I, 2J, 2K, 2L, 2M, 2N:
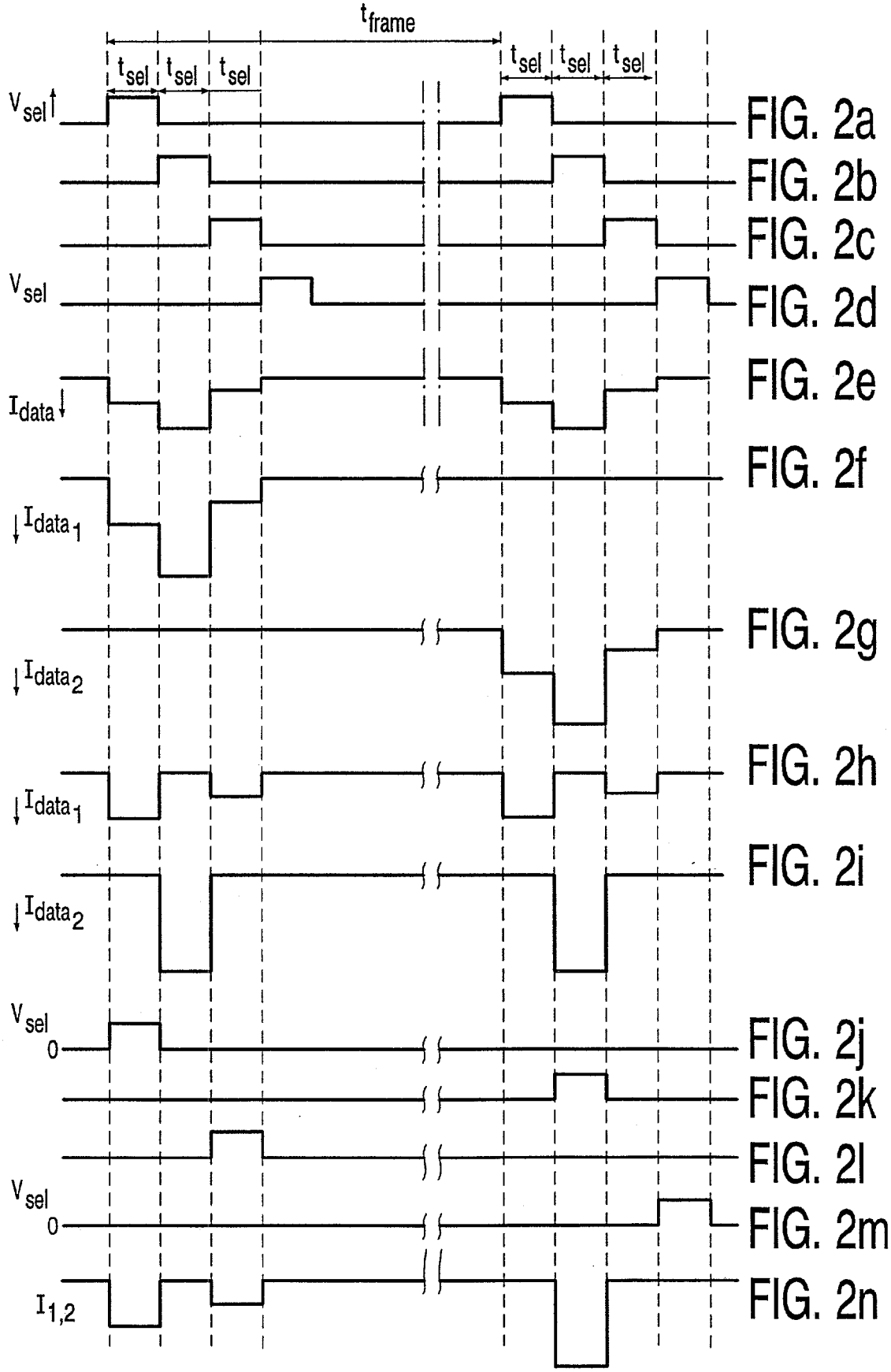
Figures 3A, 3B, 3C, 3D, 3E, 3F, 3G, 3H, 3I:
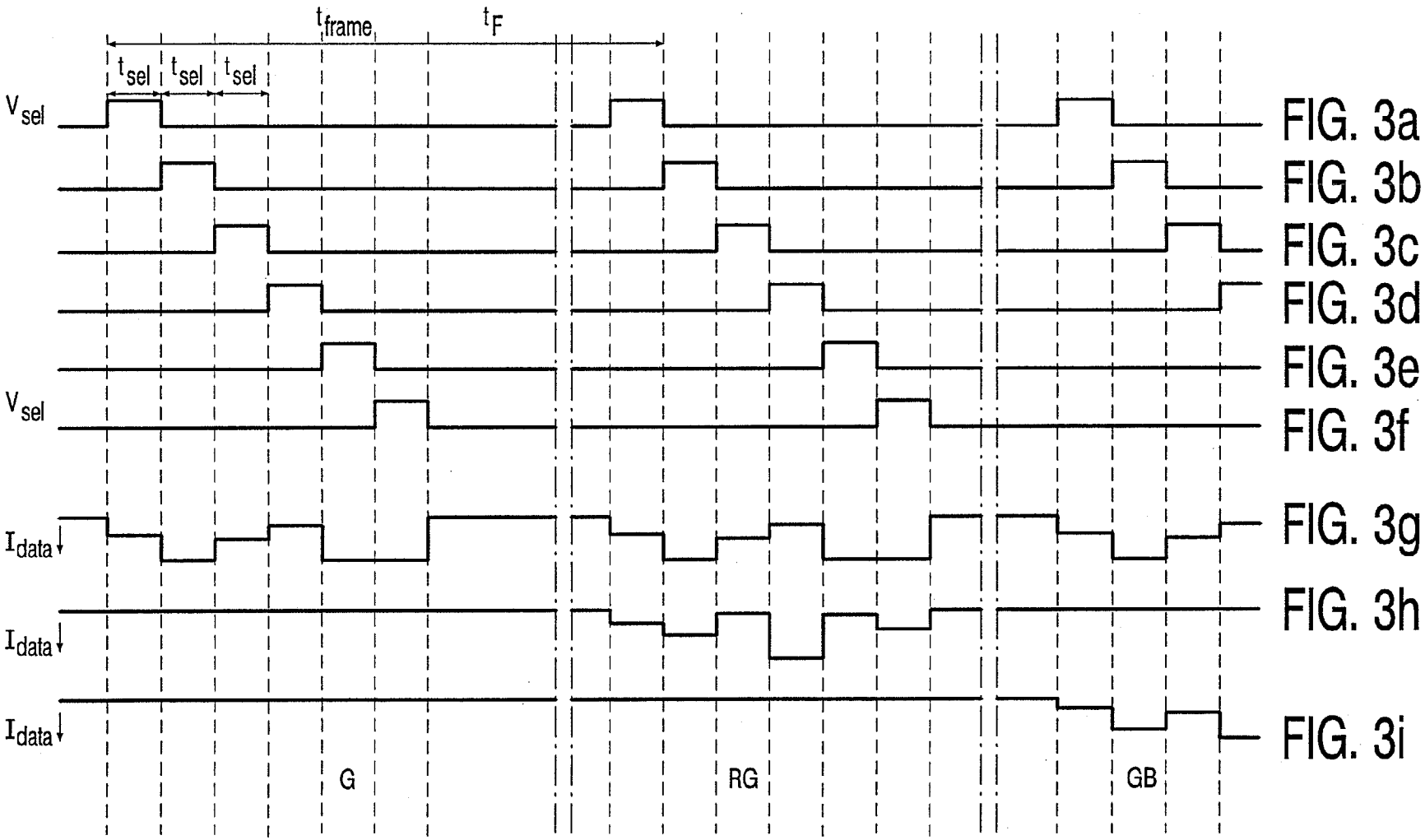

In the drawings:

FIG. 1 shows diagrammatically a display device according to the invention, while FIGS. 2 and 3 show drive signals for different embodiments.

The Figures are diagrammatic; corresponding components are generally denoted by the same reference numerals.

FIG. 1 is an equivalent circuit diagram of a part of a display device 10 according to the invention. It comprises a matrix of (O) LEDs 14 with r rows (1, 2, . . . , r) and c columns (1, 2, . . . , c). This device further comprises a row selection circuit 15 (for example, a multiplex circuit 15 which connects the row electrodes either to ground or to a voltage $V_b$ via a drive line 30 and switches 31 in this example) and a data register 16. Externally presented information 17, for example, a video signal, is processed in a processing unit 18 which, dependent on the information to be displayed, charges the separate parts 16-1, 16-2, . . . , 16-c of the data register 16 via supply lines 19, such that the bases 23 of transistors 22 (pnp transistors in this example) are supplied via the lines 21 with a voltage related to this information. In this example, the actual column conductors 12 are connected in an electrically conducting manner to the collectors 24 of the transistors 22, while the emitters 25 of these transistors are connected to an adjustable voltage via resistors 26, in this example a voltage having a value of +10 volts via a voltage source 27 which is connected to ground. The choice of the resistors 26 having a substantially identical resistance and of the voltages given by the register 16 at the bases 23 are chosen to be such in this example that a combination of a transistor 22 and a resistor 26 can be considered to be a substantially ideal current source. However, the relevant current source can only convey current when this current can be depleted via the collector. To this end, the voltage at a row electrode 13 must be sufficiently low. The relevant row selection voltages are presented by the row selection circuit 15. Mutual synchronization between the selection of the rows and the presentation of voltages on the lines 21 takes place by means of the drive unit 18 via drive lines 20, 30. Moreover, all column electrodes are to be connected to a reference voltage, in this example ground potential 34, via switches 33, for example, transistors to be described hereinafter.

In a customary drive mode, all information for a line to be driven is first stored in the data register 16. Subsequently, the row electrode 13 associated with the line, in this example the row electrode associated with line 1, is selected. To this end, the relevant switch 31 is connected to ground and, dependent on the voltages on the lines 21, currents start to flow in the current sources associated with line 1 and consequently in the LEDs.

As described in the opening paragraph, a capacitance 32 constituted by the overlapping electrodes and the intermediate layer or layers of organic material is associated with each LED. The effect of this capacitance will now be described with reference to the capacitances $C_{11}$, $C_{21}$, $C_{31}$, and $C_{r1}$ which are only associated with column 1. Although only the phenomena in column 1 are described, this description is representative of what takes place in the complete matrix of pixels.

During selection of a row of LEDs, the row electrode 13 is connected to ground via switch 31. After termination of a selection period, denoted by $t_{sel}$ in FIGS. 2, 3, and during non-selection, the row electrode 13 is connected via switch 31 to a voltage $V_b$ which is chosen to be such that the LEDs do not conduct at the customary currents and voltages in the current source 22 and at the columns 13, because these LEDs are reverse-biased. The LEDs 14 conduct, for example, from a forward voltage of about 1.5 volts. For setting grey values, a range of forward voltages of between 1.5 and 3 volts is sufficient. In practice, the voltage at the column electrodes will therefore be limited to not more than 3 volts. At a reverse voltage (or a low bias voltage) of, for example, 2 volts across the LEDs, a negligible leakage current occurs. In this example, 5 volts are chosen for $V_b$.

Simultaneously with (or immediately after) selection of the row 1, the above-mentioned current sources (the combination of a transistor 22 and a resistor 26) are activated via the separate parts 16-1, 16-2, . . . , 16-c of the data register 16 so that they start conveying a current. After selection, the LEDs are reverse-biased, as described hereinbefore. To prevent unwanted emission in the row of LEDs which has just been switched off, but also to prevent a parasitic current, this means that the capacitances $C_{11}$, $C_{21}$, $C_{31}$ and $C_{r1}$ must be discharged at least before selection of the next row to a level at which no light is emitted. To this end, the LEDs are, as it were, short-circuited at the end of the selection period by connecting the column electrodes to ground via a switch (transistor) 33. The switches (transistors) 33 (block 40 in FIG. 1) are also driven from the processing unit (drive unit) 18 via drive lines (not shown).

The current from said current sources is partly used for charging the capacitances $C_{11}$, $C_{21}$, $C_{31}$ and $C_{n1}$. At a high value of C, i.e. at an intrinsically high capacitance or in the case of many rows, it is possible that the desired voltage level is not achieved within a selection period $t_{sel}$ and the LED emits light having the wrong intensity. Moreover, charging and discharging of the capacitances unnecessarily requires much dissipation.

To prevent this, the number of pixels selected per frame period is reduced in the device of FIG. 1, for example, by supplying the pixels of the odd columns with a current, if necessary, in every odd frame period and supplying the pixels of the even columns with a current, if necessary, in every even frame period. To maintain the same luminance, the currents are doubled as compared with the current used in a drive circuit which, during use, selects all pixels per frame period.

FIG. 2 shows how such a drive is realized in a monochrome display device. The patterns (a), (b), (c) and (d) show how the first 4 lines (rows of pixels) of the display device are consecutively selected in a customary device, while pattern (e) shows the associated variation of data presented to one of the columns, shown as a current to be conveyed by the LED. The data changes in substantially every subsequent selection period $t_{sel}$ and said capacitive currents must be supplied by the current sources (pattern e).

According to the invention, only the information for the odd columns is presented to the data electrodes 12 (pattern f, $I_{data,1}$) in a first frame period during two consecutive frame periods, and only the information for the even columns (pattern g, $I_{data,2}$) is presented to the column electrodes 12 in a subsequent frame period. To obtain the same intensity of emitted light as in the case where each pixel is driven in each frame period, the quantity of current through the LED must now be doubled. The quantity of dissipation due to the DC current does not change thereby (the frequency is halved), but a considerable reduction of dissipation is obtained because the LED-associated capacitance now only needs to be charged at half the frequency.

For low grey values, an even lower frequency may be sufficient than once per two frame periods because the eye is less sensitive to flicker at these grey values. The drive unit 18 is provided with extra processing means, for example, a microprocessor or a look-up table, for this frame rate modulation. In this case, use may also be made of pulse width modulation.

In another embodiment, only the information for the odd lines is presented to the data electrodes 12 (pattern h) in a first frame period during two consecutive frame times, and only the information for the even lines (pattern i) is presented to the data electrodes 12 in a subsequent frame period. The frequency of the selection signals may also be halved (patterns j, k, l, m) in which the data patterns are again adapted to the columns (pattern n) (to be compared with interlacing when displaying images by means of a cathode ray tube).

In a color display device, separate red, green and blue signals are presented for the red, green and blue sub-frames, for example, in the same way and during three consecutive frame periods. The energy consumption due to said capacitive currents now decreases by about two-thirds.

FIG. 3 shows how possible artefacts (erky image in moving images, flicker and color break-up or color flash) can be prevented at a slightly higher energy consumption. To this end, the green pixels are driven at the full frequencies (during each frame period), while the red and blue signals are presented once per three frame periods for the red and blue sub-frames. This may also be described diagrammatically as

|-,G,-|R,G,-|-,G,B|

(Video) information is now presented via the green pixels at the full rate (every frame period) while further color information is presented at a lower frequency. Since the green color is dominant for the perception of the image, said artefacts (jerky image in moving images, flicker and color break-up) are less disturbing, if not invisible.

Several variations are possible within the scope of the invention. For example, the division as described with reference to FIG. 3 may be adapted to the typical structure of a video image, namely 60% of green, 30% of red and only 10% of blue, by means of a (repetitive) drive sequence for six consecutive frame periods

|-,G,-|R,G,-|R,G,-|-,G,-|-,G,B|R,G,-|.

Other sequences are alternatively feasible such as, for example, for three consecutive frame periods:

|-,G,-|R,G,-|R,G,B| or for four consecutive frame periods:

|-,G,-|R,G,-|-,G,B|R,-,-|

If necessary, the sequence may be dynamically adjustable and adapted to the contents of the (video) image to be displayed, using a processor in the drive unit 18.

Where, in FIG. 3, pixels are selected by a part of the column electrodes during a frame period, pixels selected analogously to the examples of FIGS. 2*h* and 2*i* can also be selected again via a part of the selection electrodes during a frame period.

Instead of the combination of red, green and blue LEDs, combinations of more colors can be chosen, while the pixels can be built up of, for example, four instead of three sub-pixels. Basic colors other than red, green and blue may be chosen alternatively. In the examples, the different colors are represented as strips in the column direction, but they may also be provided as strips in the row direction or in a delta-nabla configuration.

Use may also be made of pulse width modulation in which, for example, the drive means vary the pulse width and adjust the current through a pixel in such a way that the product of time and current for each pixel is substantially the same as in a drive circuit which, during use, selects all pixels per frame period.

The desired constant current through the LEDs may also be realized with means other than the current sources 22, 26 shown.

The protective scope of the invention is not limited to the embodiments described. The invention resides in each and every novel characteristic feature and each and every combination of characteristic features. Reference numerals in the claims do not limit their protective scope. Use of the verb "comprise" and its conjugations does not exclude the presence of elements other than those stated in the claims. Use of the article "a" or "an" preceding an element does not exclude the presence of a plurality of such elements.

The invention claimed is:

1. A display device comprising a layer of electroluminescent material between a first pattern of selection electrodes and a second pattern of column electrodes, in which at least one of the two patterns is transparent to the radiation to be emitted, while at overlap areas of the electrodes, said electrodes, jointly with the interpositioned electroluminescent material, form part of pixels, the device comprising a drive circuit which, during use, selects only a portion of the pixels per frame period.

2. The display device of claim 1, wherein the selected portion of pixels during a frame period excludes pixels defined by at least one row of the selection electrodes.

3. A display device as claimed in claim 2, comprising a matrix of pixels at overlap areas of the electrodes, wherein the pixels of the odd columns are supplied with a substantially constant current in every odd frame period, and the pixels of the even columns are supplied with a substantially constant current in every even frame period, the currents being substantially doubled as compared with the current used in a drive circuit which, during use, selects all pixels per frame period.

4. A display device as claimed in claim 2, comprising a matrix of pixels at overlap areas of the electrodes, wherein the drive means vary the pulse width and adjust the current through a pixel in such a way that the product of time and current for each pixel is substantially the same as in a drive circuit which, during use, selects all pixels per frame period.

5. A color display device as claimed in claim 2, wherein columns with pixels of different colors are driven by the drive circuit at frequencies which are dependent on the image to be displayed.

6. A color display device as claimed in claim 2, comprising n ($n \geqq 2$) sub-pixels of n colors, wherein the sub-pixels of the different colors are supplied with a substantially constant current in n consecutive frame periods, the currents being n-fold as compared with the currents used in a drive circuit which, during use, selects all pixels per frame period.

7. The display device of claim 1, wherein the selected portion of pixels during a frame period excludes pixels defined by at least one column of the column electrodes.

8. A display device as claimed in claim 7, comprising a matrix of pixels at overlap areas of the electrodes, wherein the pixels of the odd rows are supplied with a substantially constant current in every odd frame period, and the pixels of the even rows are supplied with a substantially constant current in every even frame period, the currents being substantially doubled as compared with the current used in a drive circuit which, during use, selects all pixels per frame period.

9. A display device as claimed in claim 1, wherein the drive circuit supplies a selected pixel with a substantially constant current.

10. A color display device as claimed in claim 9, wherein the sub-pixels of m ($m \leqq 1$, $m<n$) colors are supplied with a substantially constant current in each frame period, the drive means adjusting the current through a pixel in such a way that the product of time and current for each pixel is substantially the same as in a drive circuit which, during use, selects all pixels per frame period.

11. A display device as claimed in claim 9, wherein a pixel is selected only once per p frame periods and a current is passed through the pixel during selection, which current has a p-fold value as compared with the current used in a drive circuit which, during use, selects all pixels per frame period, where p is an integer greater than one.

12. A display device as claimed in claim 9, comprising a matrix of pixels at overlap areas of the electrodes, wherein the pixels of the odd columns are supplied with a substantially constant current in every odd frame period, and the pixels of the even columns are supplied with a substantially constant current in every even frame period, the currents being substantially doubled as compared with the current used in a drive circuit which, during use, selects all pixels per frame period.

13. A display device as claimed in claim 9, comprising a matrix of pixels at overlap areas of the electrodes, wherein the pixels of the odd rows are supplied with a substantially constant current in every odd frame period, and the pixels of the even rows are supplied with a substantially constant current in every even frame period, the currents being substantially doubled as compared with the current used in a drive circuit which, during use, selects all pixels per frame period.

14. A display device as claimed in claim 9, wherein grey values are obtained by means of frame rate modulation at an operating frequency, and wherein columns with pixels whose grey values to be displayed remain below a given limit value are driven by the drive circuit at a lower frequency than the operating frequency.

15. A color display device as claimed in claim 1, comprising n ($n \geqq 2$) sub-pixels of n colors, wherein the sub-pixels of the different colors are supplied with a substantially constant current in n consecutive frame periods, the currents being n-fold as compared with the currents used in a drive circuit which, during use, selects all pixels per frame period.

16. A color display device as claimed in claim 1, comprising n ($n \geqq 2$) sub-pixels of n colors, wherein the sub-pixels of one of the different colors are selected in given frame periods, and the sub-pixels of m ($m>1$, $m<n$) colors are selected in other frame periods.

17. A display device as claimed in claim 1, wherein grey values are obtained by means of frame rate modulation at an operating frequency, and wherein columns with pixels whose grey values to be displayed remain below a given limit value are driven by the drive circuit at a lower frequency than the operating frequency.

18. A display device comprising:

a plurality row electrodes;

a plurality of column electrodes opposed to and spaced apart from the row electrodes;

a layer of electroluminescent material between the row electrodes and the column electrodes, wherein a matrix of pixels are defined at areas where the row and column electrodes overlap each other; and a drive circuit which, during use, selects only a portion of the pixels during frame period, said portion excluding at least one row or one column of the pixels.

19. The display device of claim 18, wherein the pixels comprise a plurality of sub-pixels divided into n colors ($n \geqq 2$) and wherein during each frame only subpixels having m colors are selected, where $m<n$.

20. The display device of claim 19, wherein n=3 and m is 1 or 2.

* * * * *